United States Patent [19]

Yamaoka et al.

[11] Patent Number: 4,479,352

[45] Date of Patent: Oct. 30, 1984

[54] HOT-WATER STORAGE TYPE POWER GENERATING UNIT

[75] Inventors: Keijiro Yamaoka; Hajime Endo, both of Tokyo, Japan

[73] Assignee: Mitsui Engineering & Shipbuilding Co., Ltd., Tokyo, Japan

[21] Appl. No.: 400,320

[22] Filed: Jul. 21, 1982

[30] Foreign Application Priority Data

Jul. 21, 1981 [JP] Japan ..... 56-114274

[51] Int. Cl.[3] ..... F01K 3/00

[52] U.S. Cl. ..... 60/659; 60/652

[58] Field of Search ..... 60/659, 715, 682, 650, 60/670, 645, 643, 677, 679, 652; 55/41, 52

[56] References Cited

U.S. PATENT DOCUMENTS

| | | | |
|---|---|---|---|
| 3,055,170 | 9/1962 | Westcott | 60/682 |
| 3,688,502 | 9/1972 | Hasen | 60/670 |
| 3,886,749 | 6/1975 | Pacault | 60/659 |
| 3,982,379 | 9/1976 | Gilli et al. | 60/659 |
| 3,995,428 | 12/1976 | Roberts | 60/670 |
| 4,129,004 | 12/1978 | Thelen et al. | 60/679 |
| 4,130,992 | 12/1978 | Bitterlich et al. | 60/659 |
| 4,291,537 | 9/1981 | Oplatka | 60/659 |
| 4,389,847 | 6/1983 | Kehlhofer | 60/659 |
| 4,400,946 | 8/1983 | Oplatka | 60/659 X |

FOREIGN PATENT DOCUMENTS

| | | | |
|---|---|---|---|
| 142737 | 7/1980 | German Democratic Rep. | 60/659 |
| 840421 | 6/1981 | U.S.S.R. | 60/670 |

*Primary Examiner*—Stephen F. Husar

*Attorney, Agent, or Firm*—Remy J. VanOphem

[57] ABSTRACT

A hot-water storage type power generating unit includes a first tank coupled to a power generating system having a generator, a hot water producting unit for heating medium-temperature water from the first tank with exhaust heat from external equipment to produce high-temperature water, and a second tank for storing the high-temperature water from the hot water producing unit. The high-temperature water is supplied from the second tank to the power generating system for generating electric power to meet peak load demands. The power generating system includes a rotary separator turbine rotatable by the high-temperature water from the second tank for separating steam from the high-temperature water, and a steam turbine rotatable by the steam from the rotary separator turbine, the generator being operatively coupled with the steam turbine for being rotated thereby.

13 Claims, 9 Drawing Figures

HOT-WATER STORAGE TYPE POWER GENERATING UNIT

BACKGROUND OF THE INVENTION

The present invention relates to a hot-water storage type power generating unit in which medium-temperature water is heated by steam supplied from power generating equipment or exhaust heat from industrial equipment, into hot water which is stored in a tank and then supplied to a power generating system for electric power generation.

As power plants currently in operation rely on more large-scale thermal power generation and nuclear power generation, they are less flexible in power generating capability. The power plants are also facing the problem of an ever-increasing difference between electric power demands during the daytime and the nighttime. With these difficulties in view, there has been a demand for increased peak cut power generation capability.

Industrial plants of the batch process type using an arc furnace, for example, discharge exhaust thermal energy which fluctuates in temperature and flow rate to a large extent and, hence cannot be recovered easily. As an example, the temperature of an arc furnace may vary in a wide range of from higher than 1,000 degrees Celsius to about 300 degrees Celsius within a period of a few tenths of a minute. There is thus a need for a power generation system for converting such fluctuating exhaust heat efficiently into electric power, the electrical power being available at a constant rate.

SUMMARY OF THE INVENTION

Therefore, it is an object of the present invention to provide a hot-water storage type power generating unit capable of peak load power generation with a high degree of efficiency.

Another object of the present invention is to provide a hot-water storage type power generating unit which is small in size and simple in construction, and can replace a pumping-up power generating unit.

According to the present invention, a hot-water storage type power generating unit includes a first tank for storing medium-temperature water discharged from a power generating system, a high-temperature water porducing unit for heating the medium-temperature water supplied from the first tank with exhaust heat from other equipment to produce high-temperature water, and a second tank for storing the high-temperature water thus produced. The high-temperature water is supplied from the second tank to the power generating system for generating electric power under a peak load.

The above and other features, objects, and advantages of the present invention will become more apparent when the following description is read in conjunction with the accompanying drawings in which certain preferred embodiments of the invention are shown by way of illustrative example.

DESCRIPTION OF THE PREFERRED EMBODIMENTS

Figure 1:
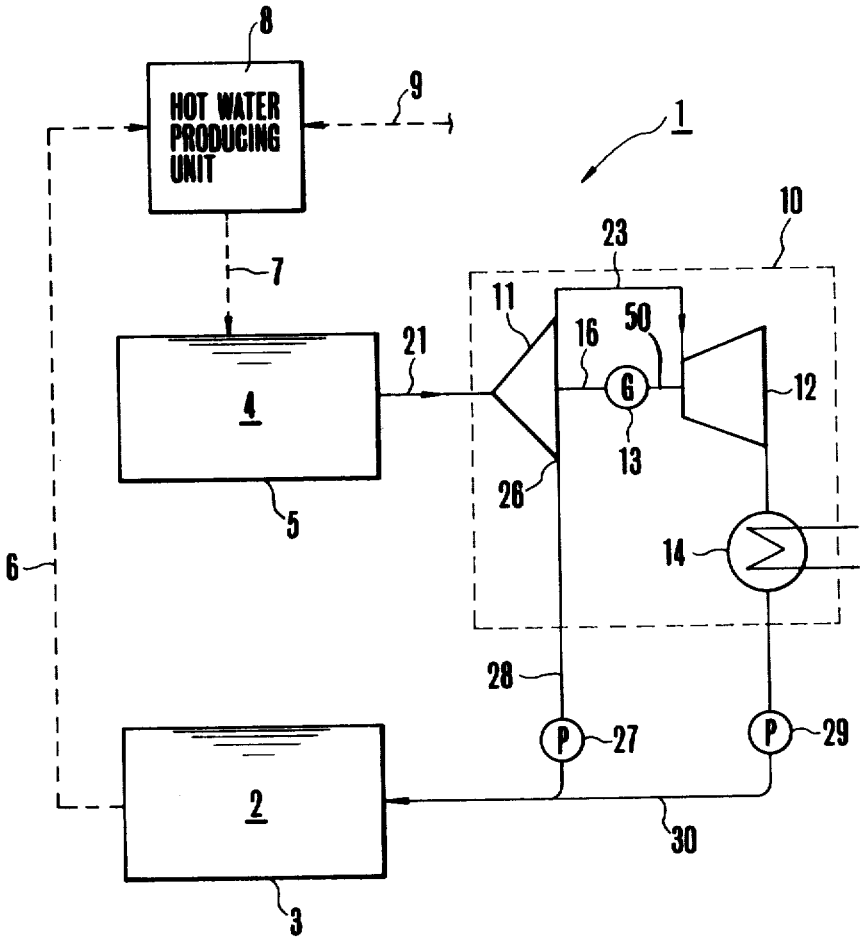
FIG. 1 is a schematic diagram of a hot-water storage type power generating unit according to the present invention.

As shown in FIG. 1, a hot-water storage type power generating unit 1 includes a first tank 3 for storing medium-temperature water 2, a second tank 5 for storing high-temperature water 4, and a hot water producing unit 8 connected to the first and second tanks 3 and 5, respectively through pipes 6 and 7. The hot water producing unit 8 is connected through a pipe 9 to the bleeding port of a high-pressure steam turbine (not shown) which is located externally of the hot-water storage type power generating unit 1. The hot water producing unit 8 serves to heat the medium-temperature water 2 from the first tank 3 with steam from the high-pressure steam turbine to produce the high-temperature water 4. The hot-water storage type power generating unit 1 also includes a power generating system 10 and includes a rotary separator turbine 11, a steam turbine 12, a generator 13 coupled to the output shafts of the turbines 11 and 12, and a condenser 14 for converting steam from the steam turbine 12 into water.

Figure 2:
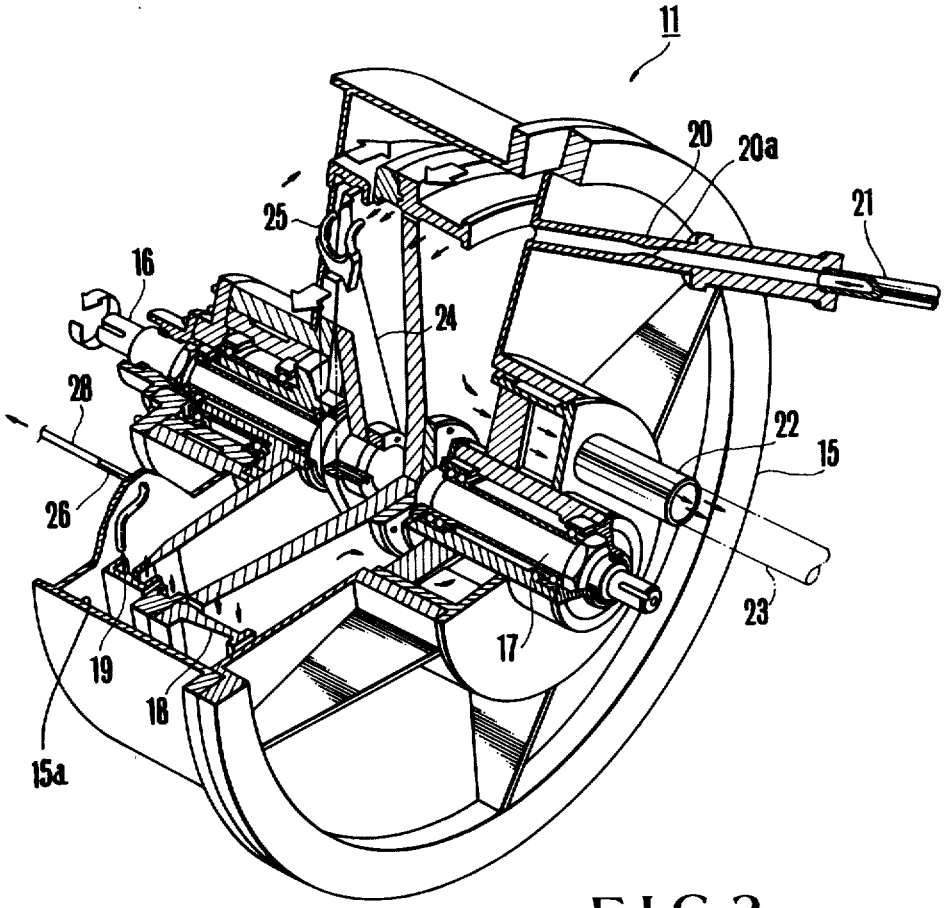
FIG. 2 is a perspective view, partly cut away, of a rotary separator turbine for rotational steam separation in the power generating unit shown in FIG. 1.

As illustrated in FIG. 2, the rotary separator turbine 11 is capable of rotational steam separation and has a housing 15 defining a chamber 15*a*, an output shaft 16 journalled in the housing 15 and connected to the generator 13, and a separator shaft 17 journalled in the chamber 15 in concentric relation to the output shaft 16. The shafts 17 and 16 support primary and secondary separators 18 and 19, respectively, which are of a disc-shaped configuration and have outer peripheral rims or flanges. A nozzle 20, which has a constricted throat 20*a*, is mounted on the housing 15 and coupled via a pipe 21 to the second tank 5. The nozzle 20 serves to supply the high-temperature water 4 from the second tank 5 as a two-phase mixture of medium-temperature water and steam into the chamber 15*a*, in which the two-phase mixture is blown against the primary separator 18 at a high speed such as to rotate the latter at the same peripheral speed as the speed of flow of the two-phase mixture. A discharge pipe 22 opens into the chamber 15*a* for discharging steam, as separated from the two-phase mixture by high-speed rotation of the primary separator 18. The discharge pipe 22 is coupled to the steam turbine 12 through a pipe 23.

The chamber 15*a* also has therein a liquid turbine 24 rotatably fitted over a boss of the primary separator 18 and has a plurality of U-shaped tubes 25 extending into inner peripheral grooves in the rims of the primary and secondary separators 18 and 19. The liquid turbine 24 can rotate in the same direction as that in which the primary separator 18 rotates in response to introduction of the medium-temperature water into the U-shaped tubes medium-temperature water collects on an outer peripheral wall of the primary separator 18 and rotates therewith under centrifugal forces generated by the primary separator 18, which rotates at a high speed. The medium-temperature water is oriented by the U-shaped tubes 25 to be discharged therefrom in an opposite direction against the secondary separator 19, which is then caused to rotate in a direction opposite to that of the rotation of the primary separator 18. The output shaft 16, attached to the secondary separator 19, rotates therewith.

The chamber 15*a* includes a discharge port 26 for discharging the medium-temperature water which is discharged from the U-shaped tubes 25 and rotates with the secondary separator 19.

The discharge port 26 is coupled through a pipe 28, having a pump 27, to the first tank 3, as shown in Fig. 1. The condenser 14 and the pipe 28 are coupled to each other by a pipe 30 having a pump 29.

The hot-water storage type power generating unit 1 thus constructed will operate as follows: While the power generating unit 1 undergoes a light load such as during nighttime, the first tank 3 is filled up with medium-temperature water 2, and valves on the pipes 6, 7 and 9 are opened to supply steam from the high-pressure steam turbine to the hot water producing unit 8. The medium-temperature water 2 supplied from the first tank 3 to the second tank 5 is heated to produce high-temperature water 4 as the water 2 passes through the hot water producing unit 5. The high-temperature water 4 is stored in the second tank 5. When an increased amount of electric power is needed as for a peak load, the valves on the pipes 6, 7 and 9 are closed, and valves on the pipes 21, 28, and 30 are opened, and then the power generating system 10 and the pumps 27 and 29 are energized. The high-temperature water 4 stored in the second tank 5 is now allowed to be supplied to the power generating system 10 for power generation. More specifically, the high-temperature water 4 is fed via the pipe 21, and accelerated by the constricted throat 20*a* of the nozzle 20, so as to take the form of a two-phase mixture of medium-temperature water and steam that flows at a high speed. The two-phase mixture, as it is ejected from the nozzle 20, is blown against the primary separator 18 to rotate the latter at a high speed. The two-phase mixture is then separated into water and steam under centrifugal forces from the primary separator 18, and the steam is discharged from the chamber 15*a* via the discharge pipe 22. The medium-temperature water collects on the peripheral wall of the primary separator 18 under the centrifugal forces thereof and rotates therewith, whereupon the medium-temperature water is picked up by the U-shaped tubes 25. The liquid turbine 24 is now caused to rotate by the medium temperature water introduced into the U-shaped tubes 25. The medium-temperature water is discharged out of the U-shaped tubes 25 in an opposite direction, and hits the secondary separator 19, which rotates in a direction opposite to that of rotation of the primary separator 18. The output shaft 16 now rotates with the secondary separator 19. The medium-temperature water which rotates with the secondary separator 19 is scooped up by and discharged from the discharge port 26.

The steam discharged from the discharge pipe 22 is supplied via the pipe 23 to the steam turbine 12, whereupon its output shaft is caused to rotate. Thus, the generator 13 coupled with the output shafts 16 and 50, respectively of the turbines 11 and 12 is actuated to generate electric power. The medium-temperature water discharged from the discharge port 26 is delivered via the pipe 28 to the first tank 3. Steam discharged from the steam turbine 12 is reduced by the condenser 14 to medium-temperature water, which is supplied by the pump 29 through the pipe 30 to the first tank 3. The medium-temperature water fed from the pipes 28 and 30 is mixed together into the medium-temperature water 2 which is stored in the first tank 3. The pump 27 serves to feed the medium-temperature water from the pipe 28 to the first tank 3, but may be dispensed with since the medium-temperature water can be discharged from the rotary separator turbine 11 under an increased pressure by controlling the rotational speed of the liquid turbine 24.

Electric power is thus generated, medium-temperature water is stored in the first tank 3, and high-temperature water is consumed in the above described manner. Thereafter, the medium-temperature water 2 in the first tank 3 is heated by the steam from the high-pressure turbine into the high-temperature water 4 which is stored in the second tank 5 under a small load. The high-temperature water is supplied from the second tank 5 to the power generating system 10 under a peak load for power generation. The foregoing cycle of operation is repeated for continued power generation.

FIGS. 3 and 4*a* through 4*c* illustrate a hot-water storage type power generating unit according to another embodiment of the present invention. The hot-water storage type power generating unit 1' shown in FIG. 3 includes a bithermal tank 31 having a partition 34 which separates the bithermal tank 31 into a first tank 32 for storing medium-temperature water 2 and a second tank 33 for storing high-temperature water 4. The bithermal tank 31 has an inner wall surface lined with thermal insulator material. The partition 34 is movable axially of the bithermal tank 31. The partition 34 is made of a material having a sufficient mechanical strength (capable of withstanding a pressure of 40 $kg/cm^3$ or higher, for example) and capable of thermal insulation, such as lightweight concrete or lightweight glass. The partition 34 includes a peripheral seal 35 for preventing water leakage between the first and second tanks 32 and 33.

The first tank 32 is coupled through a pipe 36 to a steam generation boiler (not shown). The second tank 33 is coupled via a pipe 37 to the bleeding port of a high-pressure turbine (not shown) installed externally of the hot-water storage type power generating unit. The pipe 37 includes a mixer 38 serving as a hot water producing unit and connected to the pipe 36 through a pipe 39. When the bleeding port of the high pressure turbine is opened, steam is discharged therefrom into the mixer 38. When a valve 40 is open, the same amount of the medium-temperature water 2 as that of the discharged steam is supplied from the first tank 2 to the mixer 38. The mixer 38 serves to mix the medium-temperature water 32 and the discharged steam into saturated high-temperature water 4, which is supplied to the second tank 33 for storage, upon opening of a valve 41.

Figure 3:
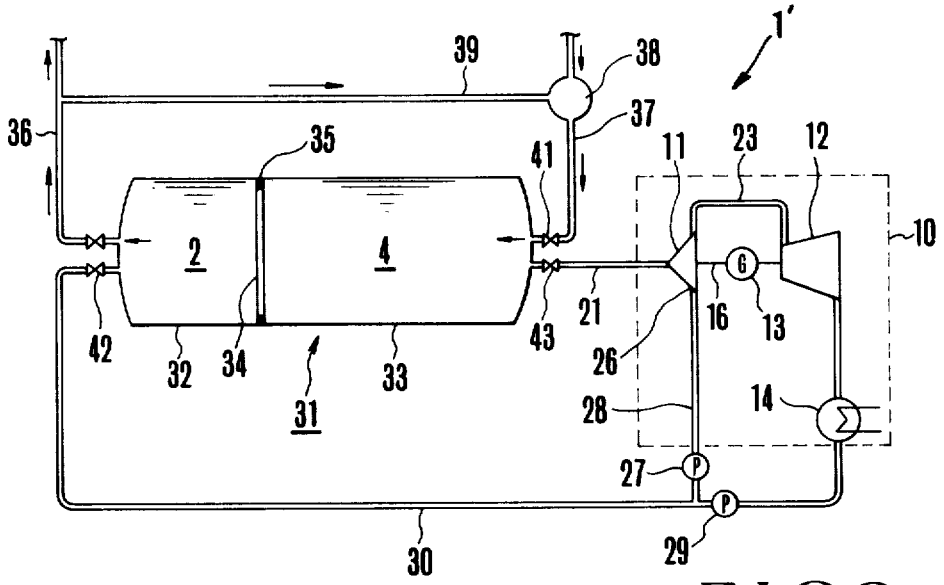
FIG. 3 is a schematic diagram of a hot-water storage type power generating unit according to another embodiment of the present invention.

The hot-water storage type power generating unit shown in FIG. 3 also includes a power generating system 10, pumps 27 and 29, and pipes 21, 28 and 30 which are of the same construction as that of corresponding parts in the power generating unit 1 as illustrated in FIG. 1 and, hence will not be described. The pipes 30 and 21 have valves 42 and 43, respectively.

Figure 4:
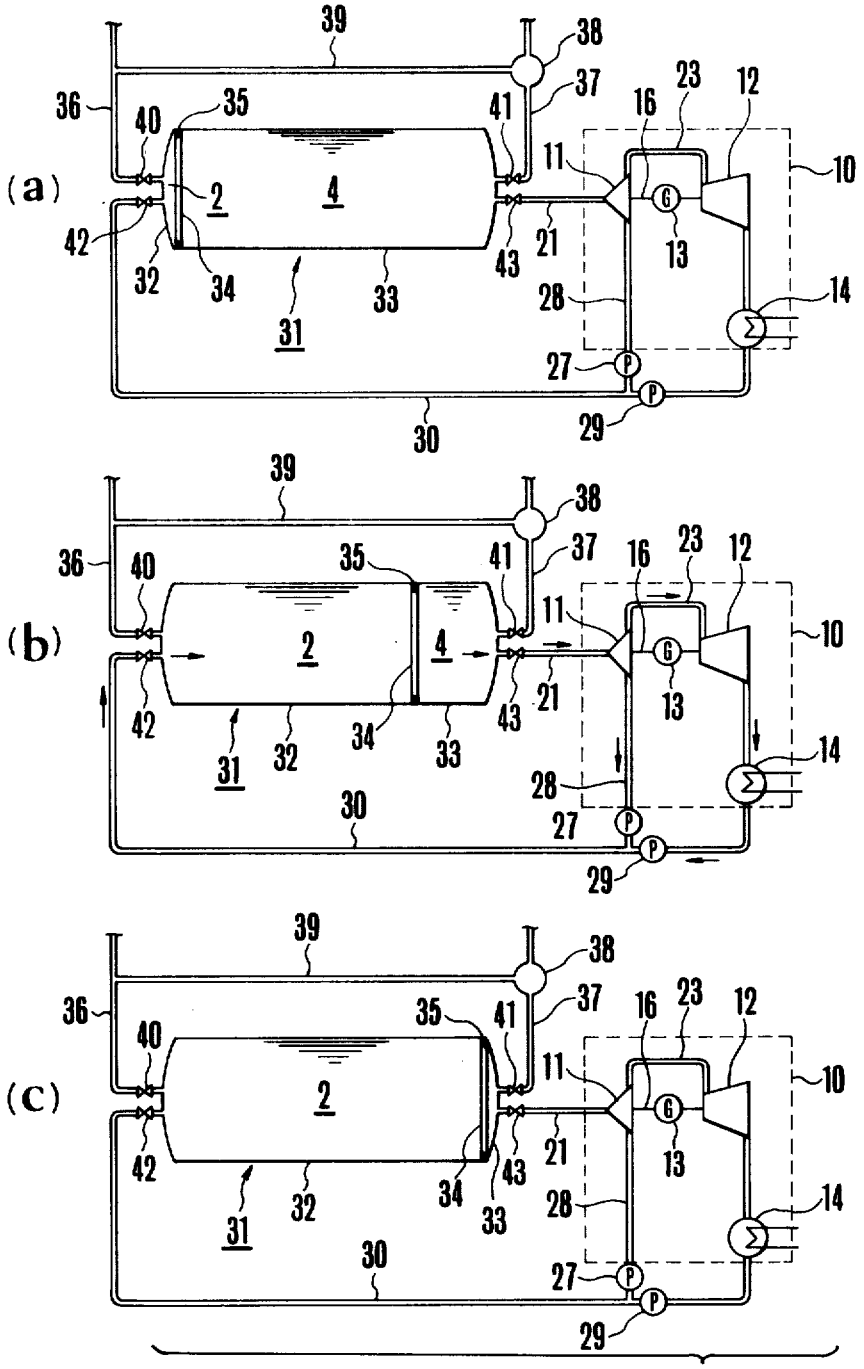
FIGS. 4(*a*) through 4(*c*) are schematic diagrams showing progressive steps of operation of the power generating unit illustrated in FIG. 3.

The operation of the hot-water storage type power generating unit 1' shown in FIG. 3 will be described with reference to FIGS. 4(*a*) through 4(*c*). When medium-temperature water 2 is filled in the first tank 32 under a reduced load, as during nighttime, as shown in FIG. 4(*b*), the partition 34 is axially moved towards the first end of the bithermal tank 31. The valves 40 and 41 are opened, and the water feed port of the boiler and the bleeding port of the high-pressure turbine are also opened. The medium-pressure steam is not introduced from the turbine into the mixer 38, and a portion of the medium-temperature water 2 from the first tank 32 is supplied to the boiler in an amount which is the same as that of the medium-pressure steam fed to the mixer 38. The rest of the medium-temperature water is supplied to the mixer 38.

The medium-temperature water 2 supplied to the mixer 38 is mixed therein with the steam, producing saturated high-temperature water 4 which is supplied via the pipe 37 to the second tank 33. As the high-temperature water 4 is continuously introduced into the second tank 33, the partition 34 is moved back, forcing the medium-temperature water 2 out of the first tank 32. During introduction of the high-temperature water 4 into the second tank 33, the valves 42 and 43 remain closed. The second tank 33 is filled up with the high-temperature water 4, as shown in FIG. 4(*a*).

To generate increased electric power to meet a peak load, the valves 40 and 41 are closed, the valves 42 and 43 are opened, and then the power generating unit 10 is started, whereupon the high-temperature water 4 stored in the second tank 33 is supplied via the pipe 21 to the rotary separator turbine 11. The high-temperature water 4 is separated by the rotary separator turbine 11 into steam and medium-temperature water. The steam is then supplied via the pipe 23 to the steam turbine 12. Rotative power from the turbines 11 and 12 is transmitted to the generator 13 coupled therewith, thus generating electric power. Steam discharged from the steam turbine 12 is converted by the condenser 14 to water, which is pressurized by the pump 29 and sent into the pipe 30. The medium-temperature water from the rotary separator turbine 11 is added to the water supplied by the pump 29 into the pipe 30. The mixed medium-temperature water in the pipe 30 is then fed back to the first tank 32, forcing the partition 34 back, as shown in FIG. 4(*b*), to push the high-temperature water 4 out of the second tank 33, during which time two phase flow power generation is carried out. When the high-temperature water 4 is fully discharged out of the second tank 33, power generation ceases, and the first tank 32 is filled up with the medium-temperature water 2, as illustrated in FIG. 4(*c*).

With the first and second tanks 32 and 33 in the form of a single combined tank with the movable partition 34 therein, the bithermal tank 31 is always filled with the medium-temperature water 2 and the high-temperature water 4, which are kept under the same pressure. The bithermal tank 31 is subjected to no heat loss due to evaporation, and has a simple and rugged construction.

Figure 5:
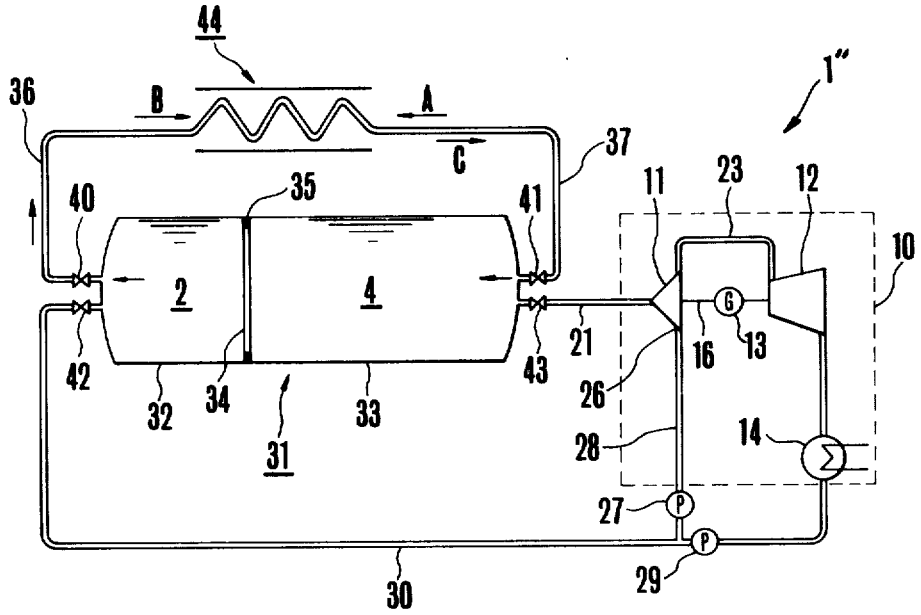
FIGS. 5 through 7 are schematic diagrams of hot-water storage type power generating units according to other embodiments of the present invention.

A hot-water storage type power generating unit 1'' according to still another embodiment of the present invention, as shown in FIG. 5, has a heat exchanger 44 serving as a hot water producing unit and utilizing, as a heat source on its high temperature side, exhaust thermal energy available from industrial equipment. The other structures of the power generating unit 1'' of FIG. 5 are completely the same as those of the power generating unit shown in FIG. 3.

In operation, when exhaust heat is introduced into the heat exchanger 44 in the direction of the arrow A, and medium-temperature water 2 flows into the heat exchanger 44 in the direction of the arrow B, the medium-temperature water 2 is heated by the exhaust heat into high-temperature water 4, which is delivered into the second tank 33 in the direction of the arrow C. Electric power is generated in the same manner as that for the preceding embodiments. Where exhaust heat is supplied from the exhaust gas discharged by industrial equipment, and hence fluctuates widely, the second tank 33 can be designed to have such a capacity that it can supply high-temperature water 4 to the power generating system 10 at a constant rate. For such a constant supply of high-temperature water 4, the valves 40 and 41 are operated to provide controlled flow rates, dependent on the amount of exhaust heat discharged, and the valves 42 and 43 remain open.

Figure 6:
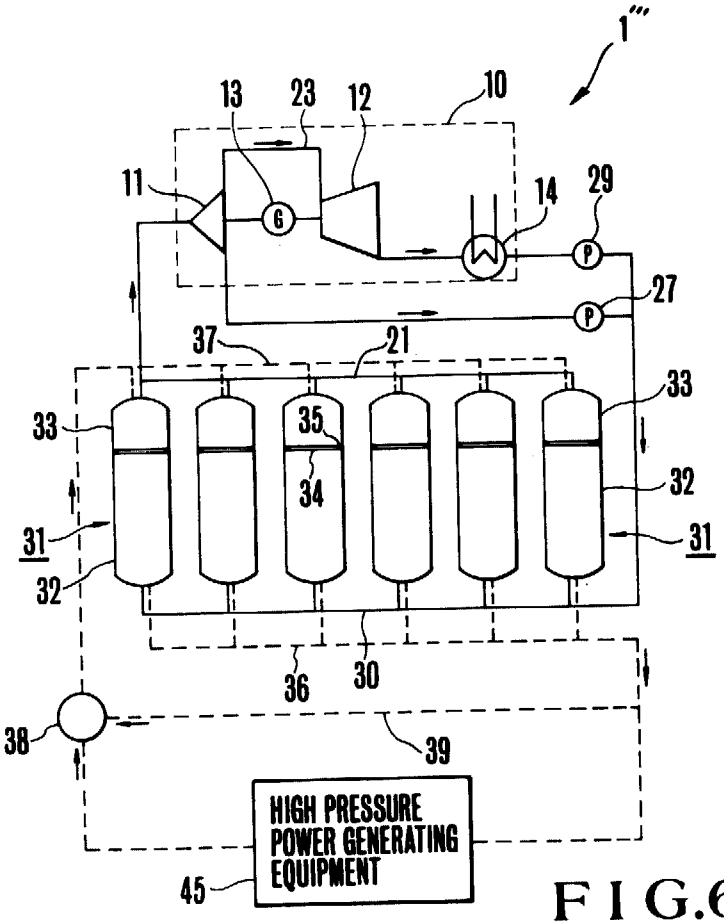

For the storage of an increased amount of high-temperature water, a plurality of bithermal tanks 31 which are of the same construction as that of the bithermal tank 31 shown in FIGS. 3 and 5, may be arranged in side-by-side relationship, as illustrated in FIG. 6. The first and second tanks 32 and 33 are coupled, respectively, through pipes 36 and 37 and pipes 30 and 21, in a parallel relation to high-pressure power generating equipment and a power generating system 10. The power generating unit 1''' shown in FIG. 6 will operate in the same way as the power generating units 1' and 1'' shown in FIGS. 3 and 5, but can store more high-temperature water.

Figure 7:
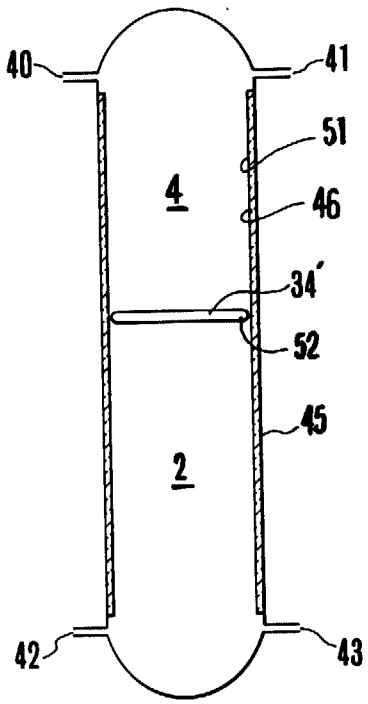

According to a still further embodiment shown in FIG. 7, a hot water storage tank 45 is disposed vertically and has a movable partition 34' for storing high-temperature water 4 above the partition 34' and medium-temperature water 2 below the partition 34'. The high-temperature water 4 and the medium-temperature water 2 have different specific gravities, and the partition 34' has a specific gravity which is intermediate between the specific gravities of the high-temperature water 4 and the medium-temperature water 2. The movable partition 34' thus can remain suspended between the masses of water 2 and 4, and will automatically be moved upwardly and downwardly dependent on the variation in the amount of each stored mass of water 2 and 4. As an example, assuming that the high-temperature water 4 has a temperature of 250 degrees Celsius and the medium-temperature water 2 has a temperature of 130 degrees Celsius, the high-temperature water 4 has a specific gravity of 0.799 g/cm$^3$, and the medium-temperature water 2 has a specific gravity of 0.939 g/cm$^3$. The movable partition 34', which has a specific gravity of 0.87 g/cm$^3$, can float between the masses of water 2 and 4.

The movable partition 34' may be in the form of a plate having a thickness of 20 cm and made of a material such as lightweight concrete or foamed glass which can withstand increased pressure and is a thermal insulator. The movable parition 34' is of a diameter selected such that there will be defined a clearance, such as 1 cm, between the periphery 52 of the partition 34' and the inner surface of the hot water storage tank 45 for taking up a contraction of the latter. The inner surface of the hot water storage tank 45 is lined with a thermally insulating material 46, which is preferably covered (such as to seal) by a metal 51, such as stainless steel. The stainless steel liner is for protection of the thermally insulating material 46 against water seepage thereinto, which water seepage may result in reduced thermal insulating capability. With the hot water storage tank 45 and the movable partition 34' being thus thermally insulated, heat transfer can effectively be prevented without a strong seal between the hot water storage tank and the partition 34'. Heat transfer due to convection may be held to a minimum by providing the seal (not shown) at the periphery 51 of the partition 34' in the form of brushes.

While in the foregoing embodiments the hot water turbine for rotational steam separation has been employed, other turbines may be used. For example, turbines of the impulse, reaction and expander types may be used, which are described in "The III Geothermal Energy Program—A Status Report on the Development of the Total-Flow Concept" by A. L. Austin et al., published by Lawrence Livermore Laboratory, Oct. 2, 1978. Although in the illustrated embodiments the power generating assembly includes, in addition to the generator 13, the rotary separator turbine 11, the steam turbine 12 and the condenser 14, the power generating system may consist of only the rotary separator turbine 11, or a combination of a hot water separater and the steam turbine 12. The source of thermal energy utilized by the hot water producing unit may be steam picked up from the high-pressure turbine or exhaust heat from industrial equipment, or alternatively steam discharged from other devices in the industrial equipment. The fluid used in the power generating unit 10 of the present invention may be other than water. As an example, an organic medium such as Fluorinol-85 manufactured by Halo-Carbon Inc., or a thermal transfer medium having a boiling point lower than that of water is available for the working fluid.

With the arrangement of the present invention, the power generating unit 1, 1', 1'', or 1''' is small and compact in size, can be constructed less costly, and takes up a smaller space for installation than prior art designs. Power generation efficiency can be increased by utilizing a total-flow power generating system in which both steam and hot water turbines are included. The hot water turbine capable of rotational steam separation can produce steam of good quality by way of better steam and water separation capability, so that the steam turbine can have improved performance. With medium-temperature water and high-temperature water tanks being in the form of a single tank having a movable partition therein, the tank is filled up with medium- and high-temperature water under the same pressure at all times, with the result that the single tank will undergo no heat loss due to evaporation, contribute to an improved power generation efficiency, and is of simple and rugged construction.

The power generating unit which is small in size and of a high power generation efficiency can effectively serve as a peak load power generating system which can replace conventional pumping-up power generating units, and can meet peak load and cut-off demands for private power generation and power generation on isolated islands. The power generating unit of the present invention can convert fluctuating exhaust thermal energy efficiently into electric power available at a constant rate. Furthermore, where the power generating unit of the invention is installed on ships, it can be used as a power generating unit utilizing exhaust heat for producing electric power both when the ship is at anchor or when it is running.

Although certain preferred embodiments of the present invention have been shown and described, it should be understood that many changes and modifications may be made thereof without departing from the scope of the appended claims.

What is claimed is:

1. A hot water storage type power generating assembly comprising:

a power generating subassembly, said power generating subassembly further comprising a rotary separator turbine for separating high-temperature water into medium-temperature water and steam, a steam turbine driven by said steam from said rotary separator turbine, and a generator operatively coupled with said steam turbine for generating electric power;

a first tank selectively interconnected with said rotary separator turbine such as to store said medium-temperature water produced by said rotary separator turbine, said first tank further being selectively interconnected with said steam turbine such as to combine the steam output from said steam turbine with said medium-temperature water;

a hot water producing device interconnected with said first tank, said hot water producing device converting said medium-temperature water into high-temperature water; and a second tank selectively interconnected with said hot water producing device, said second tank storing said high-temperature water supplied from said hot water producing device, said second tank further being selectively interconnected with said rotary separator turbine such as to selectively supply said rotary separator turbine with said high-temperature water.

2. The hot water storage type power generating assembly of claim 1 wherein said first and second tanks comprise:

a bithermal tank;

an elongated cavity formed in said bithermal tank; and a partition movably disposed in said elongated cavity such as to separate said elongated cavity into said first and second tanks, said partition being longitudinally movable in said elongated cavity in response to the variation in the amount of medium-temperature and high-temperature water stored, respectively, in said first and second tanks.

3. The hot water storage type power generating assembly of claim 1 wherein said hot water producing device comprises a heat exchanger.

4. The hot water storage type power generating assembly of claim 1 wherein said hot water producing device comprises a mixer for mixing said medium-temperature water with a supply of high-pressure steam from a high-pressure turbine.

5. The hot water storage type power generating assembly of claim 1 wherein said power generating subassembly further comprises a water turbine interposed said rotary separator turbine and said first tank, said water turbine being rotatably driven by said medium-temperature water, said power generating subassembly being operatively coupled with said water turbine such that said power generating subassembly is rotatably driven by both said water turbine and said steam turbine to generate electric power.

6. The hot water storage type power generating assembly of claim 1 further comprising a condenser interposed said steam turbine and said first tank, said condenser condensing said steam output from said steam turbine to output water, said output water being supplied to said first tank for mixing with said medium-temperature water from said rotary separator turbine.

7. The hot water storage type power generating assembly of claim 1 further comprising:

first pump means interposed said first tank and said rotary separator turbine, said first pump means delivering said medium-temperature water to said first tank; and second pump means interposed said first tank and said steam turbine, said second pump means delivering said steam output from said steam turbine to said first tank.

8. A hot water storage type power generating assembly comprising:

a rotary separator turbine for separating high-temperature water into medium-temperature water and steam;

a steam turbine rotatably driven by said steam supplied by said rotary separator turbine, said steam turbine exhausting an output steam;

a water turbine rotatably driven by said medium-temperature water supplied by said rotary separator turbine;

a generator operatively coupled with said steam turbine and said water turbine such that said generator is rotatably driven by said steam turbine and said water turbine to generate electric power;

a condenser interconnected with said steam turbine, said condenser condensing said output steam of said steam turbine to output water;

a first tank selectively interconnected with said water turbine and said condenser such as to combine and store said medium-temperature water and said output water;

a hot water producing device interconnected with said first tank, said hot water producing device converting said medium-temperature water into high-temperature water; and a second tank selectively interconnected with said hot water producing device, said second tank storing said high-temperature water supplied from said hot water producing device, said second tank further being selectively interconnected with said rotary separator turbine such as to selectively supply said rotary separator turbine with said high-temperature water.

9. The hot water storage type power generating assembly of claim 8 wherein said first and second tanks comprise:

a bithermal tank;

an elongated cavity formed in said bithermal tank; and a partition movably disposed in said elongated cavity such as to separate said elongated cavity into said first and second tanks, said partition being longitudinally movable in said elongated cavity in response to the variation in the amount of medium-temperature and high-temperature water stored, respectively, in said first and second tanks.

10. The hot water storage type power generating assembly of claim 8 wherein said hot water producing device comprises a heat exchanger.

11. The hot water storage type power generating assembly of claim 8 wherein said hot water producing device comprises a mixer for mixing said medium-temperature water with a supply of high-pressure steam from a high-pressure turbine.

12. The hot water storage type power generating assembly of claim 8 further comprising:

first pump means interposed said first tank and said water turbine, said first pump means delivering said medium-temperature water to said first tank after said medium temperature water has passed through said water turbine; and said pump means interposed said first tank and said steam turbine, said second pump means delivering said steam output from said steam turbine to said first tank.

13. The hot water storage type power generating assembly of claim 8 wherein said rotary separator turbine and said water turbine together further comprise:

a housing;

a chamber formed in said housing;

a separator turbine wheel rotatably disposed in said chamber; and a water turbine wheel rotatably disposed in said chamber adjacent said separator turbine wheel.

* * * * *

UNITED STATES PATENT AND TRADEMARK OFFICE

CERTIFICATE OF CORRECTION

PATENT NO. : 4,479,352

DATED : October 30, 1984

INVENTOR(S) : Yamaoka, et al

It is certified that error appears in the above-identified patent and that said Letters Patent is hereby corrected as shown below:

Title page, Abstract:

Line 17, delete "for" and insert ---- and ----.

Column 1, line 49, delete "porducing" and insert ---- producing ----.

Column 2, line 39, delete "cham-" and insert ---- housing ----.

Column 2, line 40, delete "ber".

Column 2, line 66, after "tubes" insert ---- 25 as the ----.

Column 3, line 26, after "as the" insert ---- medium-temperature ----.

Column 3, line 27, delete "unit 5" and insert ---- unit 8 ----.

Column 3, line 66, after "respectively" insert a comma ---- , ----.

Column 4, line 54, delete "tank 2" and insert ---- tank 32 ----.

UNITED STATES PATENT AND TRADEMARK OFFICE

CERTIFICATE OF CORRECTION

PATENT NO. : 4,479,352

DATED : October 30, 1984

INVENTOR(S) : Yamaoka, et al.

It is certified that error appears in the above-identified patent and that said Letters Patent is hereby corrected as shown below:

Column 4, line 56, delete "water 32" and insert ---- water 2 ----.

Column 5, line 7, delete "not" and insert ---- now ----.

Column 5, line 8, before "turbine" insert ---- high-pressure ----.

Column 7, line 6, delete "periphery 51" and insert ---- periphery 52 ----.

Column 7, line 35, delete "constructes less costly" and insert ---- manufactured less costly ----.

In the Claims

Column 10, line 31, delete "said pump" and insert ---- second pump ----.

Signed and Sealed this

*Eleventh* Day of *June 1985*

[SEAL]

*Attest:*

DONALD J. QUIGG

*Attesting Officer*

*Acting Commissioner of Patents and Trademarks*